United States Patent [19]

Wund

[11] Patent Number: 4,566,475

[45] Date of Patent: Jan. 28, 1986

[54] OUTDOOR RECREATION AREA COVER

[76] Inventor: Josef Wund, Ifenstrasse 12, D-7990 Friedrichshafen, Fed. Rep. of Germany

[21] Appl. No.: 653,875

[22] Filed: Sep. 21, 1984

[30] Foreign Application Priority Data

Sep. 23, 1983 [DE] Fed. Rep. of Germany ..... 3334371
Jun. 30, 1984 [DE] Fed. Rep. of Germany ..... 3424160

[51] Int. Cl.[4] ..... E04H 15/26; E04H 15/60; E04B 1/346; A47F 5/02

[52] U.S. Cl. ..... 135/99; 135/114; 135/DIG. 8; 52/65; 211/165; 248/349

[58] Field of Search ..... 135/95, 97, 99, 100, 135/102, 112, 903, DIG. 8; 211/1.5, 37, 58, 165, 163; 52/63, 64, 65, 66, 67, 72, 68, 79.5, 82; 384/300; 248/182, 349

[56] References Cited

U.S. PATENT DOCUMENTS

| | | | |
|---|---|---|---|
| 463,540 | 11/1891 | McKinnon | 211/165 |
| 493,355 | 3/1893 | Erickson | 52/65 |
| 1,101,372 | 6/1914 | Wisniewski | 52/64 |
| 2,692,566 | 10/1954 | Mitchell | 52/65 |
| 2,715,007 | 8/1955 | Zeitlin | 248/349 |
| 3,056,506 | 10/1962 | Fuller et al. | 211/1.5 |
| 3,122,257 | 2/1964 | Soehrman | 248/182 |
| 3,184,362 | 5/1965 | Litsky et al. | 384/300 X |
| 3,236,573 | 2/1966 | Donnellan | 384/300 X |
| 3,475,768 | 11/1969 | Burton | 52/63 |
| 3,641,950 | 2/1972 | Axhamre | 211/165 X |
| 4,500,060 | 2/1985 | Anderson et al. | 248/349 |

FOREIGN PATENT DOCUMENTS

| | | | |
|---|---|---|---|
| 2400993 | 7/1975 | Fed. Rep. of Germany | 52/65 |
| 702071 | 2/1951 | United Kingdom | 52/65 |

OTHER PUBLICATIONS

Architectural Record, Retractable Dome for All-Weather Arena, May 1959, pp. 250, 251.

*Primary Examiner*—Robert A. Hafer
*Assistant Examiner*—D. Neal Muir
*Attorney, Agent, or Firm*—McGlew and Tuttle

[57] ABSTRACT

An outdoor recreational area cover comprises a pylon support with a plurality of circular segment shaped cover members which have inner apices which are pivotally supported on the pylon support. All the supports are connected to the cover members at a spaced location from the pylon and they are arranged to roll over tracks or similar supports so that the cover members may be rotated around the pylon. By rotation, the cover members may be arranged so that they are foldable, one over the other, or extended fanlike to cover any desired recreational area such as a swimming pool. The segments are advantageously supported by generally vertical portions which extend downwardly from their outer ends and carry the rollers. The construction is such that the swimming pool or other area may advantageously be used when the cover members are arranged to overlie it.

14 Claims, 10 Drawing Figures

OUTDOOR RECREATION AREA COVER

BACKGROUND OF THE INVENTION

1. Field of the Invention

This invention relates, in general, to covering constructions and, in particular, to a new and useful covering device for recreational areas such as playing fields and swimming pools.

Devices to cover swimming pools are already known in numerous different embodiments. In most cases, to prevent contaminating the water and reduce heat dissipation in cool nights, a tarpaulin is pulled over the pool, or the pool is screened by a roll-up cover. Apart from the fact that handling such covering devices is very cumbersome at times, they are, when in an extended condition, at the level of the pool edge so that the distance between the water level and the covering is very small. A swimming pool protected in this manner, therefore, cannot be used in bad weather. Also, these known covering devices can be applied to small swimming pools only.

SUMMARY OF THE INVENTION

The invention provides a covering device which can be applied advantageously in particular to public open air swimming pools, playing fields, or the like, and which makes it possible to use the pool or field unhindered when the device is in a covered condition. In other words, the covered area is not only protected reliably against contamination, it makes it possible to extend the season of an open air pool considerably because it can be transformed in short order into an inside pool, as it were. The structural expense required therefore should be kept low, and servicing and handling should be simple so that the covering device can also be used often in inclement weather and at night, for instance, in order to reduce heat dissipation and, hence, the energy consumption to heat the water.

According to the invention, the covering device is characterized by one or more sections of circular segment shape, contractible in fan fashion and spaced from the surface to be covered, which segments are mounted to a pylon in the center of the circle so as to be turnable relative to each other and supported in their outer reaches so as to be movable on rollers.

It is advantageous to support the sections so as to be movable on one or more tracks disposed concentric to the pylon.

It is further expedient to construct each section of a triangular, inclined roof part and a straight or curved, vertical side part adjoining the sections in the outer area, it being possible to provide the roof parts completely or partly with a translucent roofing material preferably inserted between supports in order to utilize the solar energy not only for lighting, but also for heating the enclosed space.

For the rotatable mounting of the various sections to the pylon, it is advisable to provide vertically superposed support plates, on which is mounted by means of plain or roller bearings a support ring, each assigned to a section and preferably designed as hollow part.

To make a maintenance-free mounting mode possible, the support plates, the support rings and/or the pylon should be provided completely or partly with a friction-reducing plastic coating on their surfaces of mutual contact.

It is further expedient to equip the support rings each with two or more seating shoes, attached to the outside diameter, to seat support elements for the sections, such as lengthwise binders, so as to hold them simply and safely.

But according to another embodiment, there may also be provided in the upper end area of the pylon, for the seating of the sections, support members which are rotatably mounted on the pylon and from which the sections are each gimbal suspended.

The gimbal suspension of the sections should be provided with a holding ring which partly grips around the respective support member and on which are provided two diametrically opposed bearing bolts, or the like, which engage recesses machined into the support members. This reliably precludes canting.

In addition, to reduce friction between the mutually superposed support members and/or between them and the pylon, a friction-reducing plastic coating, such as in the form of plastic rings, should be provided.

The pylon may be designed not only in the form of a column, but also in the form of a three-legged stand provided in its upper end area with a centric extension to accommodate the support members.

To prevent the penetration of moisture and also the dissipation of heat when the covering device is closed, there should further be inserted, between the abutting edge parts of two sections movable relative to each other or between a movable section and a stationary part of the covering device, a compressible hose seal each which runs in longitudinal direction and is fastened to one of the sections or to the stationary part.

For the rotatable mounting of the side parts of the sections, they should each be provided with one or more rollers mutually spaced laterally, one of the rollers being drivable, preferably by means of an electric motor engaging a ring gear attached to it. This makes it possible to move the sections singly at will and thus open or cover the pool completely or partly.

Furthermore, it is very advantageous for the mobility of the sections to make their lower area accommodating the rollers height-adjustable so that the sections can pivot about the gimbal suspension on the support members.

In a simple embodiment, the rollers are each rotatably mounted in a preferably fork-shaped lever whose one end is linked to the respective side part and which can be pivoted by means of a servo mechanism preferably acting upon its free end. It is also expedient in this connection to provide the height-adjustable side parts on both sides of the rollers with support bases, preferably provided with a plastic coating to assure safe support with little surface pressure in the quiescent state.

If the outer section of the covering device is designed as preferably a stationary hall element, the other sections can be stored under it, especially in winter, so that only the hall element need be designed to withstand the stresses caused by snow loads.

The covering device for playing fields, swimming pools, or the like, designed in accordance with the invention is not only easy to produce designwise, i.e. economically, but above all is useable in a great many ways, making it possible to reduce the operating costs of an open air pool considerably. For, if the covering device consists of individual sections of circular segment shape mounted to a pylon so as to be turnable relative to each other and contractible in fan fashion, it presents no problem to extend or contract the various sections completely or partly without jam-ups occurring so that an open air pool can be transformed in short order into a hall pool, e.g. when the weather becomes threatening, without thereby disturbing or impairing the enjoyment of the bathers.

Accordingly, not only can the bathing season be prolonged considerably, but contaminations, particularly caused by wind, against which the pool is protected, can be nearly precluded, and the energy losses of the heated water can be reduced. Furthermore, the energy consumption of heated open air pools equipped with the covering device according to the invention, which can also be retrofitted without difficulties, is substantially reduced. This is because, if translucent roofing is chosen, the enclosed space and also the pool water is heated by the sun's rays. The maintenance costs and, hence, the profitability of an open air pool equipped with such a universally usable covering device are thus considerably improved.

Accordingly, it is an object of the invention to provide an improved covering device which comprises a pylon support with a plurality of circular segment-shaped cover members which have inner apices pivotally supported on the pylon support and outer ends which carry roller means supporting the cover members for pivotal movement around the pylon so that they may be foldable inwardly one over the other or extended outwardly fanlike to cover an entire area.

A further object of the invention is to provide a covering device which is simple in design, rugged in construction and economical to manufacture.

The various features of novelty which characterize the function are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

GENERAL DESCRIPTION OF THE PREFERRED EMBODIMENTS

Figure 1:
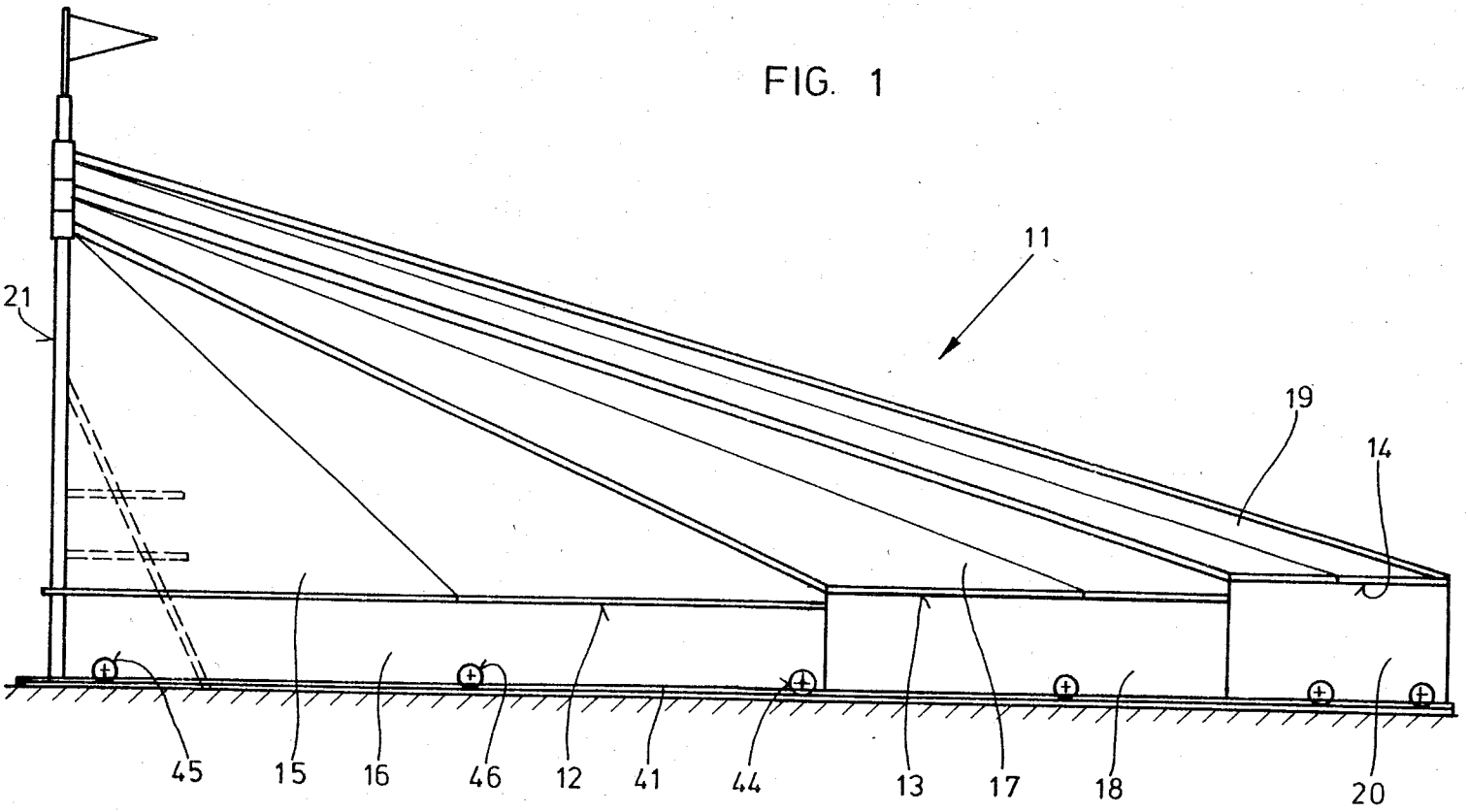
FIG. 1 is a front elevational view of the covering device formed of individual, movable sections attached to a pylon.
Figure 2:
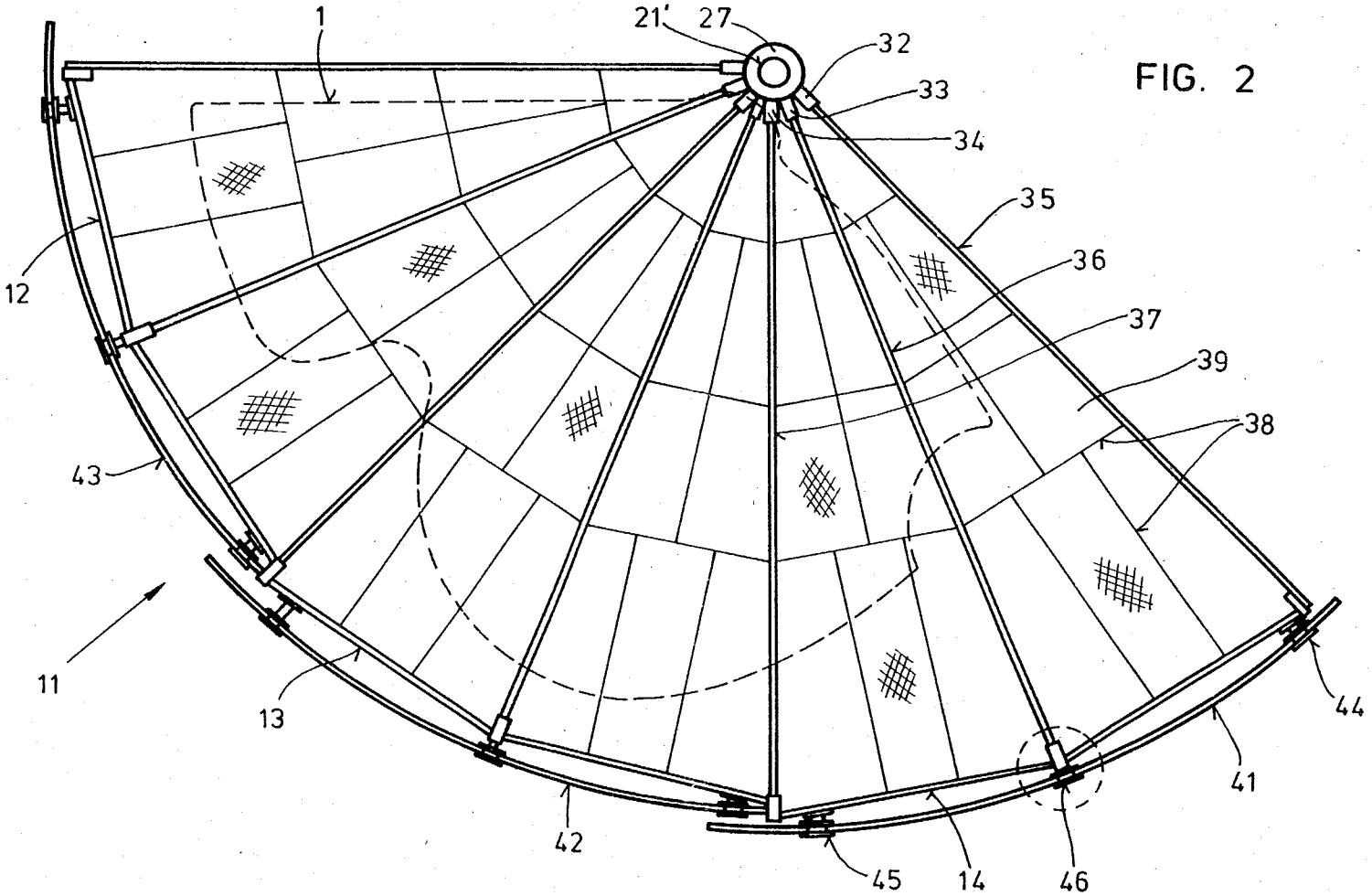
FIG. 2 is a top plan view of covering device per FIG. 1.

Referring to the drawings, in particular, the invention embodied therein comprises a covering device designated 11 in FIGS. 1 and 2 which includes a pylon support 21 in the plurality of segment-shaped cover members 12, 13 and 14 which have inner apices which are pivotally supported on the pylon support 21. The cover members also have outer ends which carry roller means 44, 45, and 46 which support the cover members for rotation around the pylon support. The cover members 12, 13 and 14 are foldable, one under the other, in a collapsed condition and they may be extended fan-like in an extended position to cover the recreation area.

The covering device 11 shown in FIGS. 1 and 2 serves to cover a swimming pool 1 for protection against contamination and wind and to prevent the water from radiating heat, and it comprises the individual sections 12, 13, 14 of circular segmental shape which are movable relative to each other and each mounted in the center of the circle to the pylon 21 designed in the form of a column. The sections 12, 13, 14 are composed of roof parts 15, 17 and 19, respectively, inclined towards with outside, and of areal side parts 16, 18 and 20, respectively, to which are attached rollers 44, 45, 46 supported on concentrically disposed tracks 41, 42, 43.

Figure 5:
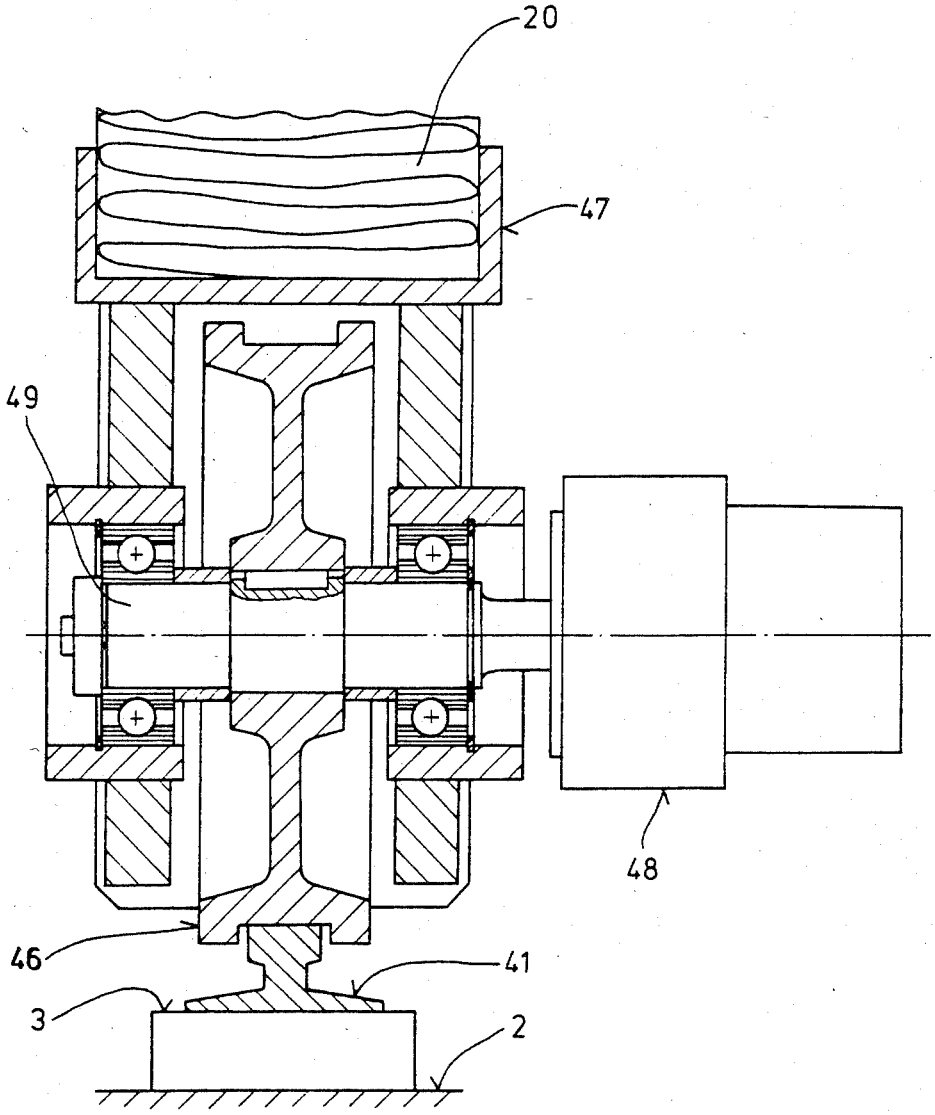
FIG. 5 is a sectional view of one embodiment of the driven roller of a section, pertaining to the covering device shown in FIG. 1.

As shown in FIG. 5, each center roller is equipped with an electric motor 48 whose driven shaft 49 is mounted in a bearing block 47 provided on the side part 20. The driven shaft 49 supports the roller 46 which rolls on a track 41 supported by the ground 2 by means of a base 3. This makes it possible to move each one of the sections 12, 13, 14 at will so that the swimming pool 1 can be entirely or partly covered or opened, as desired, especially since one track can be provided for each section. Since the sections 12, 13, 14 are of triangular shape, bathing is not impaired even when the covering device 11 is closed, rather, the open air pool is transformed into an enclosed pool, as it were.

Figure 3:
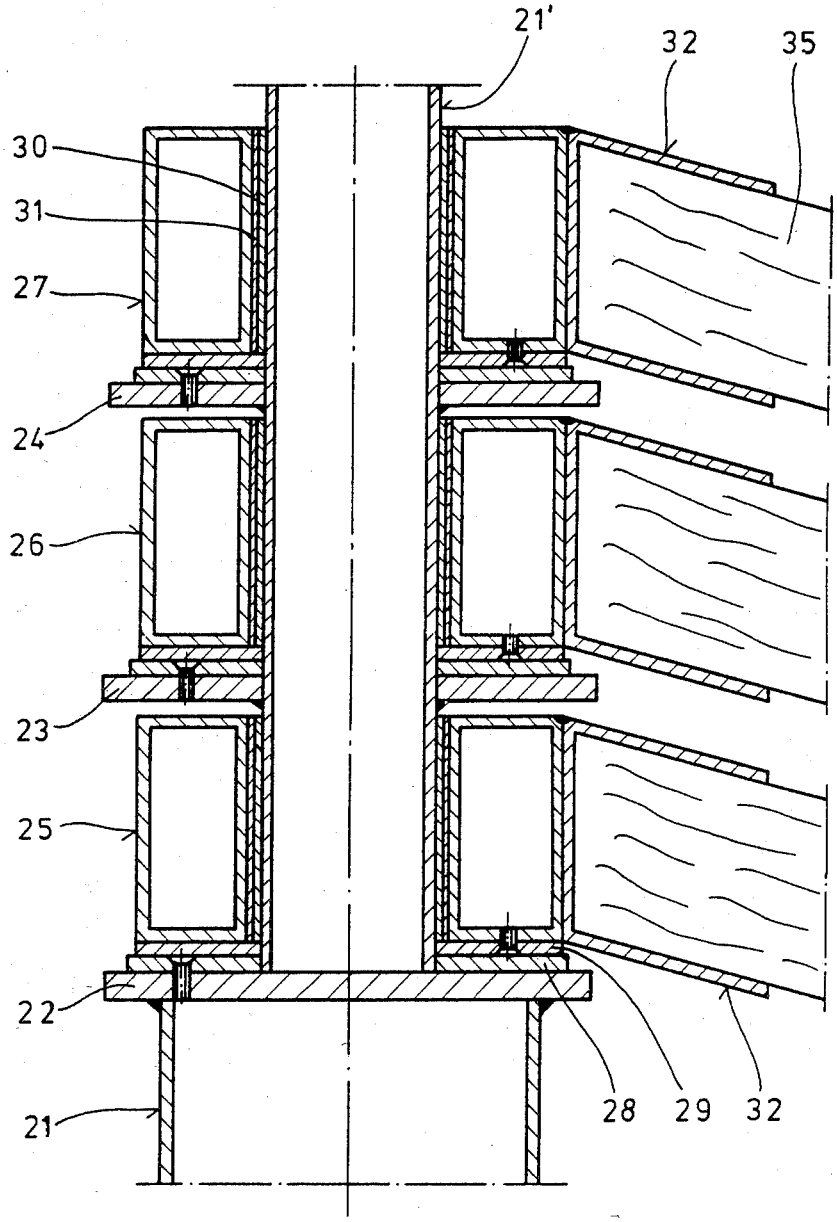
FIG. 3 is a vertical sectional view which shows the mounting of the various sections of the pylon.

For the rotatable mounting of the various sections 12, 13, 14, a support plate 22 and an extension 21' are mounted on the pylon 21, as shown in FIG. 3, and, with mutual spacing axially, more support plates 23 and 24 on which support rings 25, 26, 27 are carried, are welded to said extension. The support rings 25, 26, 27, designed as hollow parts, are provided with three seating shoes 32, 33, 34 in which binders 35, 36, 37, respectively, are retained. To make the mounting of the support rings 25, 26, 57 maintenance-free, a plastic layers 28, 29, 30, 31, is provided on all contact surfaces of the extension 21', of the support plates 22, 23, 24 and of the support rings 25, 26, 27.

The roof parts 15, 17, 19 of the sections 12, 13, 14 having a translucent roofing material 39, such as in the form of glass inserts disposed between the binders 35, 36, 37 and cross struts 38. The solar energy is thus also utilized to heat the space enclosed by the roof 11.

Figure 4:
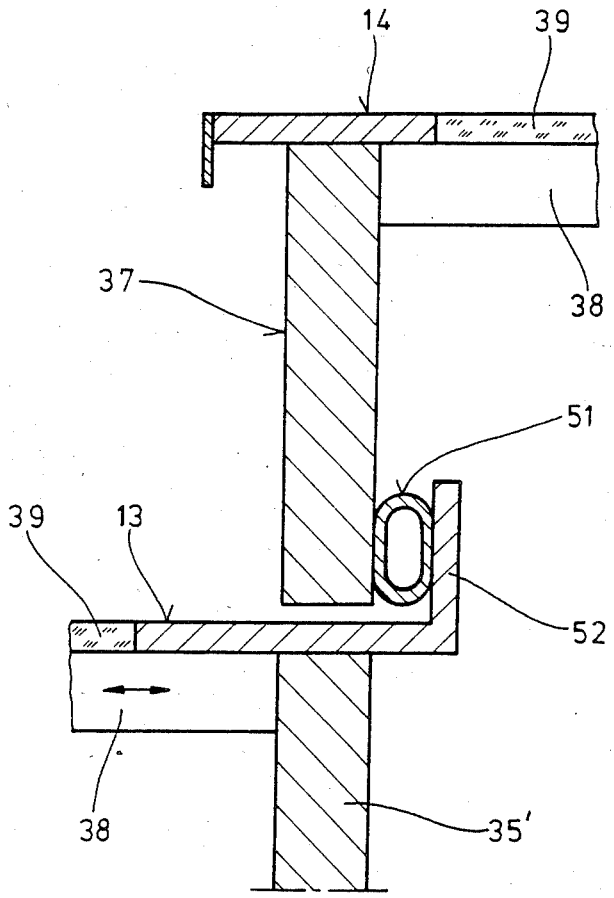
FIG. 4 is an enlarged partial section showing the seal between two sections movable relative to each other.

To prevent the penetration of moisture into the open air pool transformed into an enclosed pool and to prevent the escape of heated air from it, a compressible hose seal 51 is insereted between the abutting parts of each of the sections 12, 13, 14, as shown in FIG. 4. For this purpose there is fastened to the binder 35' of section 13 and angle 52, one leg of which engages around the hose seal 51. Hose seal 51 is fastened to the binder 37 of section 14. By moving section 13 to the left or section 14 to the right the hose seal 51 is compressed so that the gap between the sections 13 and 14 is closed almost airtight.

Figure 6:
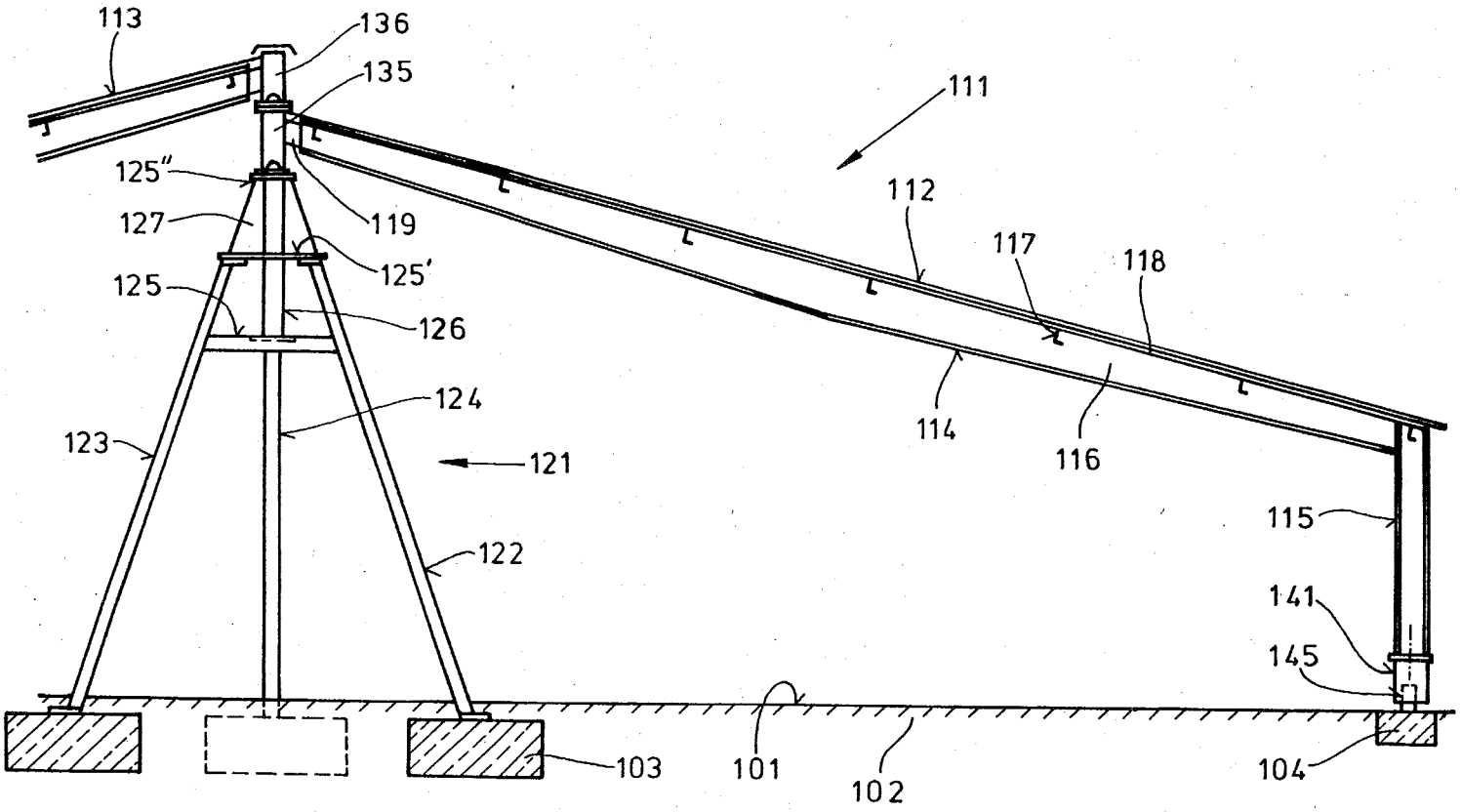
FIG. 6 is a front elevational view similar to FIG. 1 of a covering device supported by a differently designed pylon.

The covering device 111 according to FIG. 6 also consists of sections 112 and 113 movable relative to each other, each being formed of an inclined roof part 114 and a side part 115. The roof parts 114 are again constructed of longitudinal binders 116 and transverse purlins 117, on which is disposed a roof 118, preferably of a translucent material. In the embodiment example according to FIG. 6, the pylon 121 supporting the sections 112, 113, is designed as a three-legged stand whose various supports 122, 123, 124 are rigidly interconnected in the upper area by support plates 125, 125', 125'', In addition, they and gussets 127 retain a centric extension 126, from which the sections 112, 113 are gimbal suspended. The supports 122, 123, 124 are supported on footings 103 provided in the ground 102.

Figure 7:
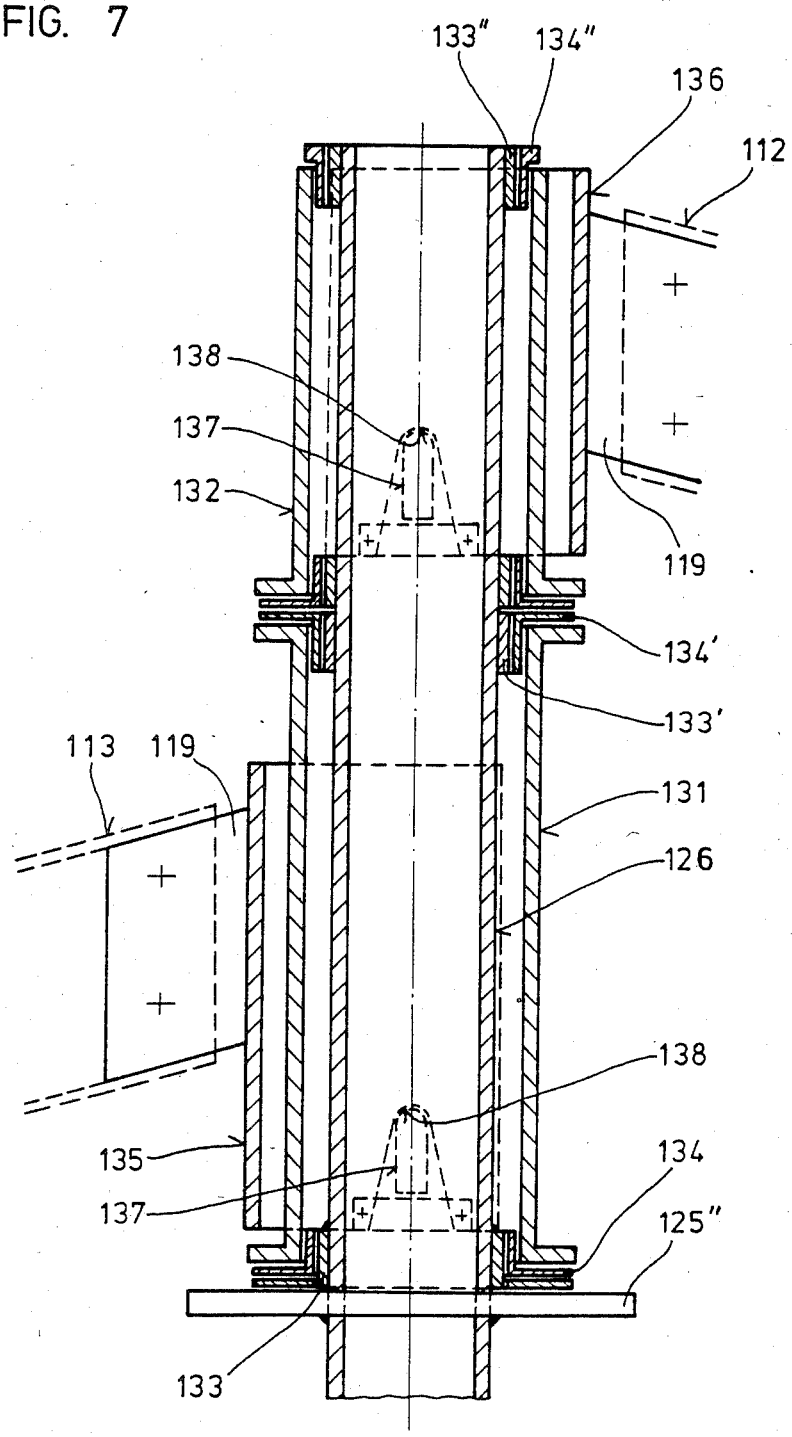
FIG. 7 is a sectional view similar to FIG. 5 of the mounting of the various sections to the pylon, pertaining to the covering device per FIG. 6, in a longitudinal section.
Figure 8:
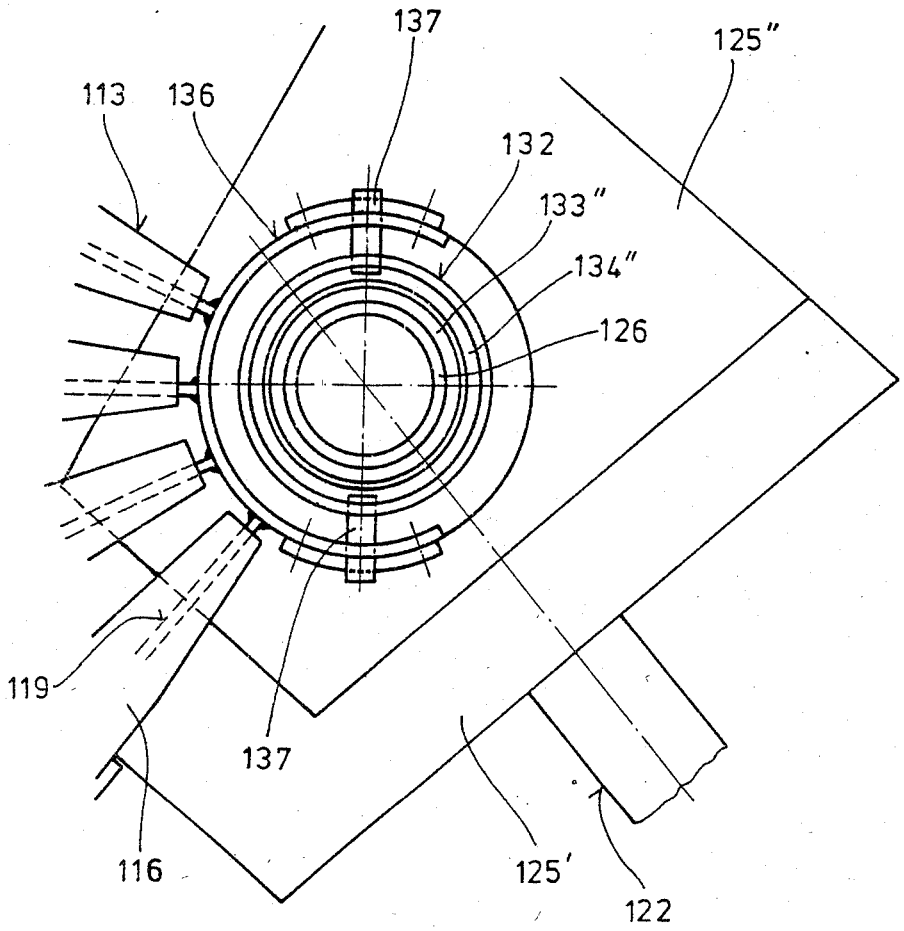
FIG. 8 is a top view of the embodiment of FIG. 7.

As may be seen from FIGS. 7 and 8, the gimbal suspension of the sections 112, 113 is provided by support members 131 and 132 which are mounted for rotation on extension 126 members 131 and 132 carry holding rings 135, 136 which are fastened to the sections 112, 113 by means of sheet metal connectors 119. Two engaging recesses 138 machined into the lower edge of each ring 135, 136. Diametrically opposed bearing volts 137 are fixed to members 131 and 132 which extend into recesses 138 and support the rings 135, 156. Therefore, given the fact that the holding rings 135, 136 are spaced from the support members 131, 132, and the sections 112, 113 are spaced from the support members 131, 132, the sections 112, 113 can be pivoted about the bearing bolts 137, which virtually precludes canting. In addition, to reduce friction, there are welded to the extension 126 rings 133, 133', and 133'', with plastic rings 134, 134', and 134'' inserted between them and the support members 131, 132.

Figure 9:
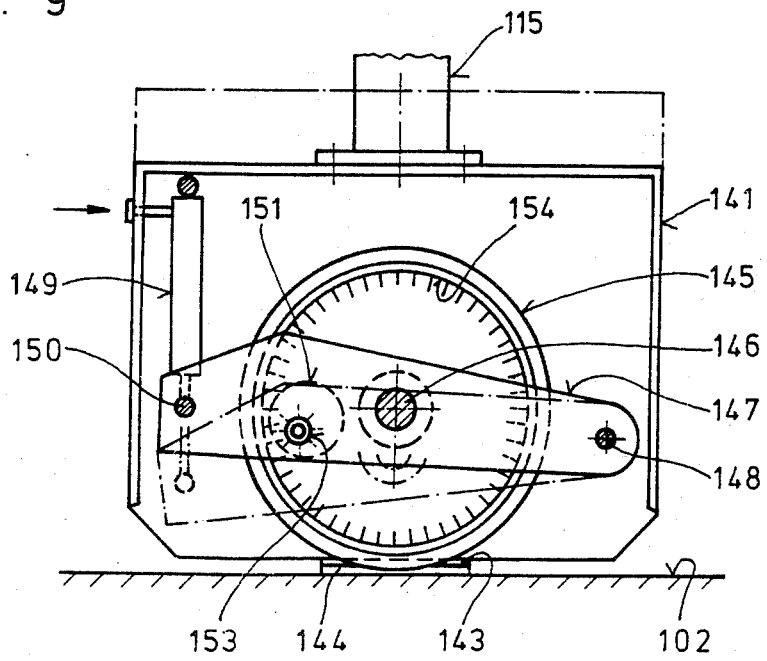
FIG. 9 is a sectional view of the roller holding view bracket on a movable section of the covering device shown in FIG. 6, in front view.
Figure 10:
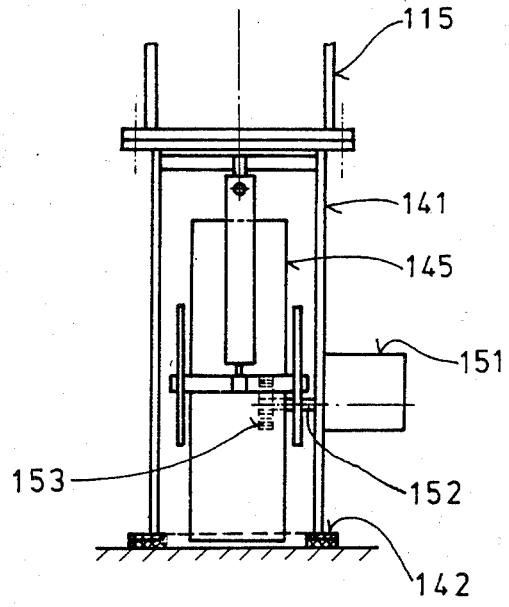
FIG. 10 is a side view of the roller holding bracket shown in FIG. 9.

According to FIGS. 9 and 10, a driven roller 145 each is provided to move the sections 112, 113 in order to cover the playing field 101 by means of the covering device 111 or to open it up, and the sections 112, 113 are height-adjustable in their lower area. To be able to compensate this in a simple manner, the roller 145 is mounted to a shaft 146 retained in a dual-armed lever 147 linked by means of a bolt 148 to a housing 141 fastened to the side part 115. A servo mechanism 149, designed in the form of a piston inserted in a cylinder, acted upon by a pressure medium and supported by the dual-armed lever 147, acts upon the latter's free end so that the section 112 is lifted off the ground 102, the housing thus assuming the position shown dash-dotted, as soon as the servo mechanism 149 pushes the lever arm 147 down. This causes the section 112 to pivot about the bearing bolts 137 of the gimbal suspension. If, in this operating state, the roller 145 is driven e.g. by an electric motor 151, and a gear 153 mounted so its driven shaft 152 engages a ring gear 154 mounted to the roller 145, it is easy to move the section 112. The roller 145 then rolls on a footing 104 (FIG. 6) placed in the ground 102.

To spread the weight of the section 112 in the quiescent state, two staunchions 142 are provided on the housing 141 on both sides of the rollers 145, each consisting of a metallic plate 143 and a plastic coating 144 applied to it. Minor motions of the sections 112, 113, such as caused by wind forces, can thereby be compensated.

While specific embodiments of the invention have been shown and described in detail to illustrate the application of the principles of the invention, it will be understood that the invention may be embodied otherwise without departing from such principles.

What is claimed is:

1. A covering device comprising a pylon support, a plurality of circular segment-shaped cover members having inner apices pivotally supported on said pylon support and outer ends, roller means connected to said cover members at a spaced location from said pylon support and supporting said cover members for rotation around said pylon support, said cover members being foldable one under the other, when contracted, and being spreadable fan-like into an extended position, a support member for each of said cover members rotatably mounted on said pylon and gimbal suspension means for each of said cover members rotatably engaged on said support members.

2. A covering device according to claim 1, including track means spaced outwardly from and an extending around said pylon, said roller means including rollers engaged on said track means.

3. A covering device according to claim 1, wherein said cover members comprise a triangular each inclined a roof part and a vertical side part at their outer ends.

4. A covering device according to claim 3, wherein said groups of parts are provided with translucent roofing material.

5. A covering device according to claim 1 wherein said gimbal support means include a holding ring connected to each cover member which partly grips around said support member for each cover member respectively, a pair of diametrically opposed bearing bolts carried on each of said support members, said holding rings each having recesses into which said bearing bolts engage for supporting said holding rings.

6. A covering device according to claim 1 including a friction-reducing plastic layer in the form of a plastic ring provided between said support members said support members being superposed one above the other and having a radially extending flange at each end.

7. A covering device according to claim 1, wherein said pylon support comprises a three-leged stand, having an upper area with a central extension and including a support member for each of said cover members carried on said pylon seated on the upper end area of said central extension.

8. A covering device according to claim 1, wherein said cover members include abutting edge parts with an overlying section including a downwardly, extending straight portion and an underlying section comprising an angle member having an outer upwardly extending portion spaced from said vertical portion and including a compressible hose seal disposed between said vertical portions, said angle member and said vertical member.

9. A covering device according to claim 1 wherein said cover members include a generally horizontally extending portion and a vertical portion, said roller means comprising spaced rollers carried at the bottom of said vertically extending portion, and drive means for driving at least one of said rollers including an electric motor having a drive shaft and ring gear means provided between said drive shaft and said roller.

10. A covering device according to claim 1, including level adjustment means for each cover member connected between said roller means and each cover member for adjusting a level of said roller means with respect to said cover members for raising and lowering said cover members on said roller means.

11. A covering device comprising a pylon support, a plurality of circular segment-shaped cover members having inner apices pivotally supported on said pylon support and outer ends, roller means connected to said cover members at a spaced location from said pylon support and supporting said cover members for rotation around said pylon support, said cover members being foldable one under the other, when contracted, and being spreadable fan-like into an extended position, a gimbal suspension pivotally holding said cover members to said pylon and wherein said cover members include a lower portion having said roller means and means for adjusting the level of said cover members.

12. A covering device according to claim 11, wherein said roller means includes a roller housing containing a roller for each of said cover members, said means for adjusting the level of said cover members comprising means mounting said rollers for movement upwardly and downwardly in respect to said housing means, said housing having support stanchions at the bottom thereof for supporting each cover member with said rollers moved upwardly.

13. A covering device according to claim 10, wherein said roller means includes a roller for each of said cover members, a fork-shaped lever having one end linked to a respective part of said cover members in an opposite end, an actuator member having a moving piston movable in a cylinder, said piston having a connecting rod connected to said lever and being actuatable to raise and lower said lever to lift and retract said wheels.

14. A covering device according to claim 10, wherein one of said cover members comprises a stationary member which is anchored in respect to said pylon and comprises a weather condition member under which all of the other members may be positioned in a folded condition.

* * * * *